United States Patent [19]

Zierpka

[11] Patent Number: 4,650,063

[45] Date of Patent: Mar. 17, 1987

[54] ADVANCEMENT DEVICE FOR STEP-WISE ADVANCEMENT OF WORK

[76] Inventor: Günter Zierpka, Elfenweg 2, 7500 Karlsruhe 51, Fed. Rep. of Germany

[21] Appl. No.: 692,028

[22] Filed: Jan. 16, 1985

[30] Foreign Application Priority Data

Jan. 19, 1984 [DE] Fed. Rep. of Germany ..... 3401703

[51] Int. Cl.[4] ..... B65G 25/00

[52] U.S. Cl. ..... 198/621

[58] Field of Search ..... 198/621, 774, 750, 627; 414/149–151

[56] References Cited

U.S. PATENT DOCUMENTS

| | | | |
|---|---|---|---|
| 3,011,464 | 12/1961 | Danly . | |
| 3,746,184 | 7/1973 | Wallis | 198/621 |
| 3,970,191 | 7/1976 | Oldfield et al. | 198/774 |
| 4,044,886 | 8/1977 | Sender | 198/750 |
| 4,542,616 | 9/1985 | Ulrich et al. | 198/627 |

FOREIGN PATENT DOCUMENTS

| | | |
|---|---|---|
| 945386 | 1/1956 | Fed. Rep. of Germany . |
| 1254076 | 11/1967 | Fed. Rep. of Germany . |
| 1811302 | 10/1969 | Fed. Rep. of Germany . |
| 2206407 | 11/1979 | Fed. Rep. of Germany . |
| 2814118 | 12/1982 | Fed. Rep. of Germany . |
| 3215700 | 10/1983 | Fed. Rep. of Germany . |
| 3320830 | 12/1984 | Fed. Rep. of Germany . |
| 7220607 | 6/1972 | France . |
| 7908137 | 4/1979 | France . |

*Primary Examiner*—Joseph E. Valenza
*Assistant Examiner*—Kyle E. Shane
*Attorney, Agent, or Firm*—Erwin S. Teltscher; Peter R. Ruzek

[57] ABSTRACT

The present invention relates to an advancement device particularly adapted for use in a press for step-wise transport of material or of a workpiece; two gripper rails spaced from one another extend therein along a transport path. The gripper rails are reciprocally movable together along an advancement direction, while being movable in respective opposite directions along a direction transverse to the advancement direction. Two longitudinal guides receive the gripper rails, respectively, and a transverse drive drives the longitudinal guides in the respective opposite directions along the transverse direction. An advancement sled is reciprocally movable along the advancement direction, and an advancement drive drives the advancement sled reciprocally along the advancement direction. The gripper rails are connected to the advancement sled rigidly along the advancement direction, but are movably connected thereto along the transverse direction. The improvement includes at least one drive being a wrap-around drive, which defines a drive direction, and wherein the wrap-around drive includes two rerouting rollers spaced from one another, each defining an axis of rotation extending approximately at right angles to the drive direction, a toothed belt guided over the rerouting rollers, and having oppositely movable belt strands, a transfer device movable along the drive direction, and a connecting arrangement rigidly connecting at least one of the strands to the transfer device, and wherein the transfer device is operatively connected to the gripper rails.

13 Claims, 4 Drawing Figures

ADVANCEMENT DEVICE FOR STEP-WISE ADVANCEMENT OF WORK

BACKGROUND OF THE INVENTION

The present invention relates to an advancement device for step-wise transport of material and/or a workpiece, and which is particularly adapted for use in a press; the advancement device includes two gripper rails spaced from one another, which extend along a transport path. The gripper rails are reciprocally movable together along an advancement direction, while being movable in respective opposite directions along a direction transverse to the advancement direction. Two longitudinal guides receive the gripper rails, respectively, and a transverse drive is provided for driving the longitudinal guides in the respective opposite directions along the transverse direction. An advancement sled is reciprocally movable along the advancement direction, and an advancement drive is provided for reciprocally driving the advancement sled along the advancement direction. The gripper rails are connected to the advancement sled rigidly along the advancement direction, but are movably connected thereto along the transverse direction.

Advancement devices of this type are known, and described, for example, in U.S. Pat. No. 3,011,464 and in German laid-open specification 22 06 407, in which gripper rails spaced from one another and extending along a transport direction are jointly movable reciprocally along an advancement direction, and are driven in a direction transverse to the advancement direction in respective opposite directions by means of rotating cam disks and by means of suitable transfer elements. In view of the precision required for the manufacture and operation of cam disk drives, or for driving of cam disks, such advancement devices are extremely expensive. Since the operating strokes are fixed in the respective directions of movement, once the dimensions of the cam disk drives are set, matching of such drives to any changed operating conditions is not possible, or feasible only at an inordinately high expense.

Thus in an advancement device of the prior art, which is described in German patent DE-AS No. 28 14 118, there is provided a transmission ratio gearing of an adjustable stroke between a cam disk drive and an advancement sled, wherein the latter is reciprocally movable along an advancement direction. This device of the prior art permits a certain change of the operating stroke along the advancement direction within predetermined limits. Naturally an advancement device with a transmission ratio gearing used in the advancement drive is very expensive.

SUMMARY OF THE INVENTION

It is therefore an object of the present invention to devise an advancement device for step-wise transport of material and or work, which is inexpensive and simple in construction compared to devices of the prior art, and which is particularly adapted for use in presses, although not limited thereto.

This object is attained, according to the present invention, in a device of the aforedescribed type by at least one of the drives including wrap-around drive means defining a drive direction, and wherein the wrap-around drive means includes two rerouting roller means spaced from one another, each defining an axis of rotation extending approximately at right angles to the drive direction, toothed belt means guided over the rerouting roller means, and having oppositely movable belt strands, transfer means movable along the drive direction, and connecting means rigidly connecting at least one of the belt strands to the transfer means, and wherein the transfer means are operatively connected to the gripper rails.

Instead of the expensive cam disk drives used in the devices of the prior art there is provided in the present invention a wrap-around or endless drive for generating the drive movements of the gripper rails along at least one direction of movement; the endless drive includes a substantially play-free toothed belt, and the toothed belt, in turn, is in operative engagement with the gripper rails through suitable transfer means.

To the extent that the advancement drive for generating the reciprocal movements of the gripper rails is implemented as an endless wrap-around drive, in one version of the invention the transfer means includes, or is constituted by the advancement sled. Hence the advancement sled is reciprocally moved in dependence of the forward or reverse movement of the one of the belt strands; this, in turn results in a common reciprocal or to-and fro movement of the gripper rails, in view of the rigid coupling provided between the gripper rails and the advancement sled in the advancement direction. According to a further feature of the invention, the belt strands include at least an upper belt strand and a lower belt strand, and the advancement drive means extends below the advancement sled, and includes the wrap-around drive means, and the upper belt strand is rigidly connected to the advancement sled.

According to another feature of the invention the advancement drive means includes two advancement drives spaced from one another along the transverse direction, and wherein the toothed belt means includes two toothed belts associated with the advancement drives, respectively, each toothed belt having one strand thereof connected to the advancement sled, and wherein the end-less wrap-around drives are advantageously disposed at equal respective lateral spacings from a center plane between the gripper rails. Each rerouting roller means includes a pair of rerouting rollers, each rerouting roller defining an axis, the axes of each pair of rerouting rollers being aligned with one another so as to coincide with a corresponding axis of rotation. Advantageously a corresponding pair of rerouting rollers can be mounted on a common shaft.

Another feature of the invention resides therein that each advancement drive has an outer side, and wherein a motor is disposed near one of the outer sides so as to operatively drive one pair of the rerouting rollers; the motor is advantageously disposed between the rerouting rollers of that pair. The drive motor may be a known stepper motor, whose drive direction is reversible, or it may, for example, be a quadrant-controlled motor. A reversible hydraulic motor may also be used instead of an electric motor.

Where the transverse drive for generating the opening and closing movements of the gripper rails is provided with a wrap-around drive including a toothed belt, a further important feature of the invention consists in one strand being connected rigidly to the transfer means, and wherein the transfer means includes one transversely movable longitudinal guide of one gripper rail, while the other strand is operatively coupled to the other transversely movable longitudinal guide of the other gripper rail, for example being also rigidly connected to the other transversely movable longitudinal guide.

In an advantageous embodiment the wrap-around drive means extends in a direction transverse to the advancement direction below the transversely movable longitudinal guides of the gripper rails, and wherein the axes of rotation of the rerouting roller means, which carry the toothed belt, extend along the longitudinal direction of the gripper rails, and hence along the advancement direction.

In an embodiment of that type, where the belt strands include an upper strand and a lower strand, it is an advantage if the upper strand is rigidly connected to one longitudinal guide of one gripper rail, and wherein a slider, which is movable along the transverse direction, is coupled to the lower strand, as well as to the other longitudinal guide of the other gripper rail. In this manner the slider, and consequently the gripper rail coupled thereto, execute respective oppositely directed movements with respect to that gripper rail, whose transverse longitudinal guide is directly and rigidly coupled to the upper belt strand; these movements take place in dependence of the forward and return travel of the toothed belt.

Finally, a distinctive feature of the invention resides in the connecting means including locking means adjustable in tension, and operatively connecting one belt strand to the transfer means, and wherein the locking means includes at least one threaded bolt engaged with a threaded bore formed in an entrainment portion of the transfer means. The transfer means may be implemented as a sled reciprocally movable along the advancement direction in the case of an advancement drive. In the case of a transverse drive, however, the transfer means may be implemented either by the transversely movable longitudinal guides of the gripper rails, or by only one transversely movable guide and a slider coupled to the corresponding belt strand of the toothed belt, and wherein the slider, in turn, is rigidly coupled to the transversely movable longitudinal guide of the other gripper rail.

BRIEF DESCRIPTION OF THE DRAWING

For a fuller understanding of the nature and objects of the invention, reference should be had to the following detailed description, taken in connection with the drawing, in which.

DESCRIPTION OF THE PREFERRED EMBODIMENTS

Figure 1:
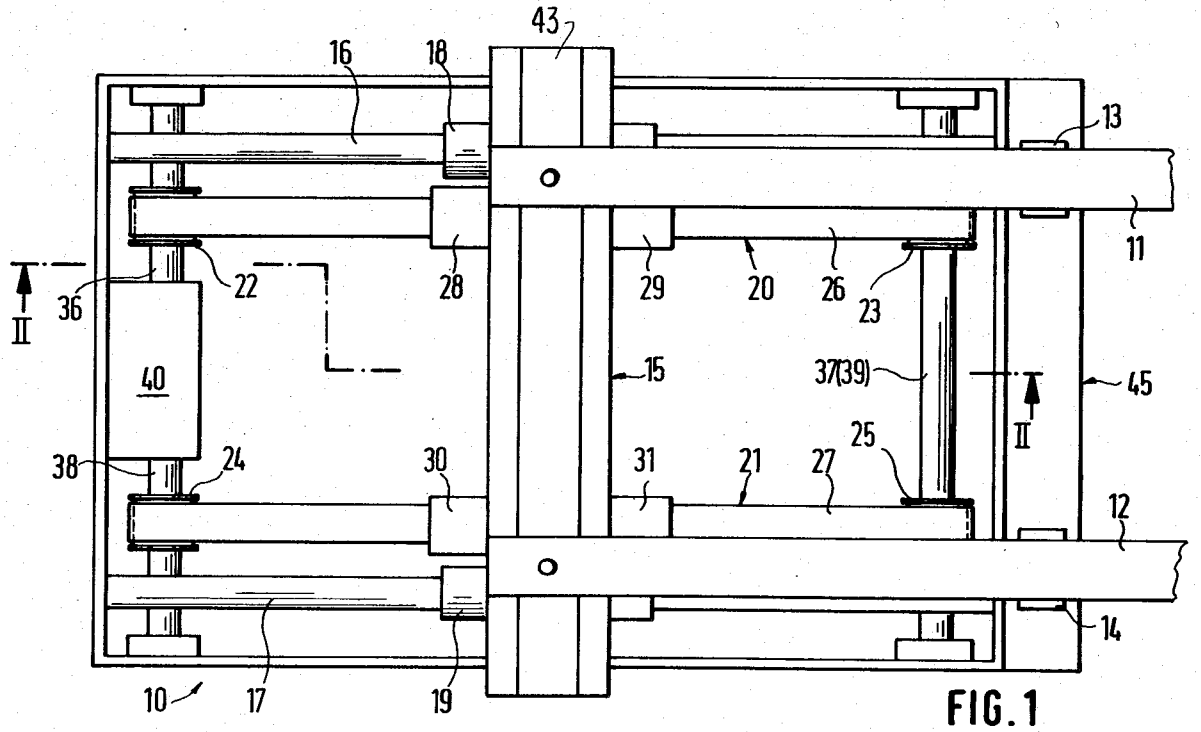
FIG. 1 is a plan view of an advancement drive mechanism including two endless wrap-around drives spaced from one another, and fragmentary gripper rails.

In the advancement device 10 shown in the drawing and which includes a frame 10*a*, there extend along an advancement path two gripper rails 11 and 12, which are adapted to be operable, for example, by means of a press, and which are spaced from one another. The gripper rails 11 and 12, in turn, are received in longitudinal guides 13, 14 driven along a direction transverse to the longitudinal direction, and described in detail in what follows. The gripper rails 11 and 12 are rigidly coupled in the advancement direction to an advancement sled 15, although they are coupled thereto so as to be movable along the transverse direction. The advancement sled 15, in turn, is reciprocally movable along the advancement direction by means of two guidance rods 16, 17 received in respective guide sleeves 18, 19; the guidance rods 16 and 17 are spaced from one another, and extend along the direction of the gripper rails 11, 12, and below thereof. The frame 10*a* defines a longitudinal border 100, a transverse border 102 of a predetermined width smaller than the length of the longitudinal border 100, and a longitudinal center line 104.

The advancement sled 15 is driven by drive means such as two wrap-around drives 20, 21, implemented by means of rerouting rollers 22, 23, and 24, 25, over which, in turn, there extend toothed belts 26 and 27, respectively, along the advancement direction; the rotatable axles of the rerouting rollers extend at right angles to the advancement direction. The wrap-around drives are disposed in a region between the two guidance rods 16, 17 so as to guide the advancement sled 15; the upper strands of the toothed belts 26, 27 are coupled through two tensionable lock pairs 28, 29, and 30, 31 to a lower connecting rigid member of segment 32 of the advancement sled 15. Within each tensionable lock a segment of the toothed belt is clamped in a manner not further illustrated by clamping means, while on a side remote from the toothed belts there are disposed respective threaded bolts 33, which, in turn, are threaded into corresponding threaded bores 34 of the connecting segment 32 of the advancement sled 15. It will be understood that the toothed belts may be tensioned more or less in dependence of the engagement depth of the aforementioned threaded bolts in the respective threaded bores 34 formed in the connecting segment 32.

Figure 3:
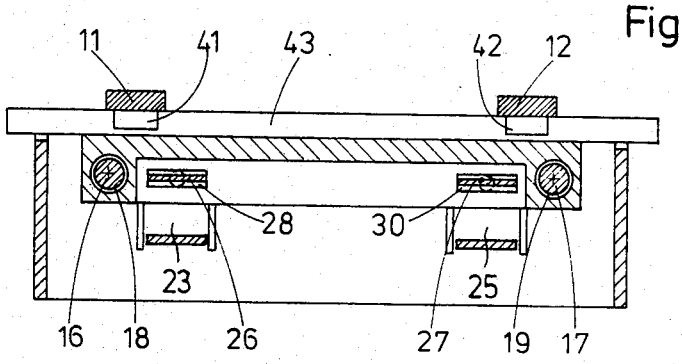
FIG. 3 is a cross-section along the line III—III of the advancement drive mechanism of FIG. 2, and including the reciprocally movable advancement sled.

As is particularly clearly shown in FIG. 1, the rerouting rollers 22, 23, and 24, 25 guiding the respective toothed belts 26, 27 are received on cooperating shaft pairs 36, 37, and 38, 39, respectively. The shafts 36 and 38 are aligned with one another, while the shafts 37 and 39 may either be aligned with one another, or, as shown in FIG. 1, may be implemented as a single shaft. An electric motor 40 is disposed between the shafts 36 and 38, which generates and controls the reciprocal movements of the advancement sled 15, and consequently also of the gripper rails 11, 12. A coupling which links the gripper rails 11, 12 to the advancement sled 15 is rigid in the advancement direction, but is movable in a direction transverse to the direction of advancement; it consists, as best seen in FIG. 3, of coupling means, such as entrainment members 41, 42 disposed below the gripper rails, which are in engagement with a groove 43 of the advancement sled 15. The groove 43 extends along the direction transverse to the advancement direction.

Figure 2:
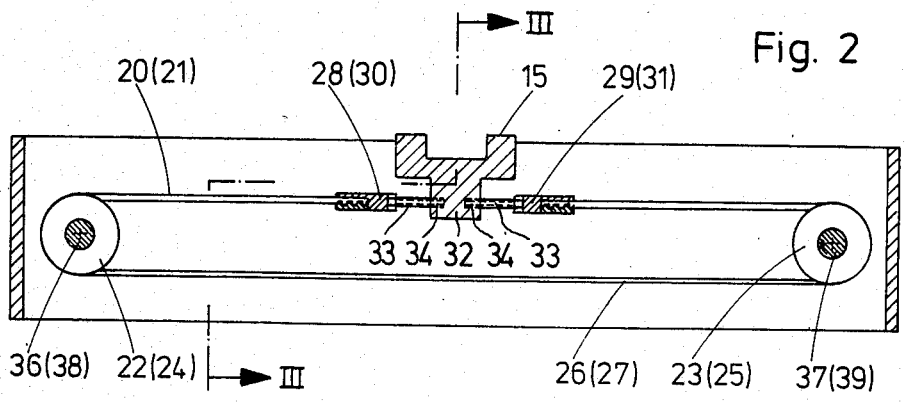
FIG. 2 is a cross-section of the advancement drive mechanism along line II—II of FIG. 1, including the advancement sled driven by the toothed belt guided over rerouting rollers, but omitting for clarity's sake the gripper rails, which are rigidly coupled to the advancement sled along the advancing direction, but are coupled thereto so as to be movable along the transverse direction.
Figure 4:
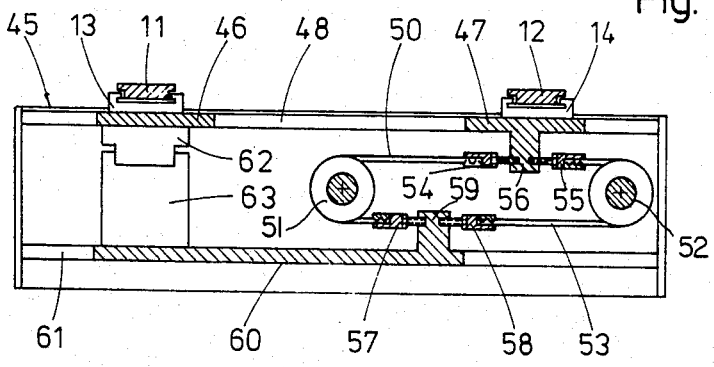
FIG. 4 is a sideview, similar to that of FIG. 3, of a transverse guidance unit including the transversely movable longitudinal guides of the gripper rails, and the transverse drive for generating the oppositely directed gripper closing- and opening-movements.

In FIG. 4 there is shown a version of transverse drive means, such as a transverse guidance unit 45 which has gripper rails 11, 12 spaced from one another, which, in turn, are received in respective transversely movable longitudinal guides 13, 14. The longitudinal guides 13, 14 for the gripper rails are in turn, disposed on respective transverse guide plates 46, 47, and the latter are movable in a direction transverse to the advancement direction in corresponding guidances 48 of the transverse guidance unit substantially in mirror symmetry away from, and towards a center line 104. Within the transverse guidance unit there is disposed an endless wrap-around drive 50, which extends transverse to the direction of advancement, and which includes two rerouting rollers 51, 52 spaced from one another, over which there is guided a toothed belt 53. The rerouting rollers 51, 52 have rotatable axles which extend in the direction of advancement, while the upper strand of the toothed belt 53 is linked by means of two tensionable locks 54, 55 to a connecting segment 56 of the transverse guide plate 47 in a manner similar to that already described with reference to FIG. 2. The guide plate 47, in turn, carries the longitudinal guide 14 of the gripper rail 12. The tensionable locks 54, 55 also operate in a manner similar to that already described in connection with FIG. 2. The lower strand of the toothed belt 53 of the endless wrap-around drive is also coupled rigidly to a connecting segment 59 of a slider 60 by means of two tensionable locks 57, 58. The slider 60 is movable in a guide groove 61 of the transverse guidance unit 45 along a direction transverse to the advancement direction, and is connected to the transverse guide plate 46 by means of a coupling, which consists of a coupling pin 62, and a pin-receiving member 63; the transverse guide plate 46, as has already been pointed out, is equipped with a longitudinal guide 13 which, in turn, receives the gripper rail 11.

During a corresponding forward or return movement of the endless wrap-around drive 50, which may, for example, be driven by a reversible stepper motor, the upper and lower strands of the toothed belt 53 execute respective opposite movements of equal magnitude. These movements, in turn, are transmitted to the gripper rails 11, 12, and are independent of the common forward and return movements of the gripper rails 11, 12 along the advancement direction; this independence is due to the coupling of the strands, on one hand, to the transverse guide plate 47, which receives the longitudinal guide 14, and, on the other hand, to the transverse guide plate 46, which is coupled to the slider 60. As will be seen from FIG. 1, the advancement drive means and the transverse drive means are disposed within the longitudinal and transverse borders of the frame 10*a*.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. In an advancement device for step-wise transport of material or of a workpiece, and particularly adapted for use in a press, and including two gripper rails spaced from one another and extending along a transport path, said gripper rails being reciprocally movable together along an adavncement direction, while being movable in respective opposite directions along a direction transverse to the advancement direction, two longitudinal guides receiving said gripper rails, respectively, transverse drive means for driving said longitudinal guides in said respective opposite directions along said transverse direction, transfer means reciprocally movable along the advancement direction, advancement drive means for reciprocally driving said transfer means along said advancement direction, said gripper rails being connected to said transfer means rigidly along said advancement direction, but being movably connected thereto along said transverse direction, the improvement comprising said transverse drive means drive means including wrap-around drive means defining a drive direction, said wrap-around drive means extending in a direction transverse to said advancement direction below said transversely movable longitudinal guides, said wrap-around drive means including two rerouting roller means spaced from one another, each defining an axis of rotation extending approximately at right angles to said drive direction, and along said advancement direction, toothed belt means guided over said rerouting roller means, and having oppositely movable belt strands, said belt strands including an upper strand and a lower strand, said transfer means being movable along said drive direction, and including one of said longitudinal guides, said upper strand being connected to said one of said longitudinal guides, connecting means rigidly connecting at least one of said belt strands to said transfer means, said transfer means being operatively connected to said gripper rails through at least one of said belt strands, and a slider movable along said transverse direction, and coupled to the other of said longitudinal guides.

2. The advancement device as claimed in claim 1, wherein said belt strands include at least an upper belt strand and a lower belt strand, wherein said advancement drive means extends below said transfer means, and includes said wrap-around drive means, and wherein said upper belt strand is rigidly connected to said transfer means.

3. The advancement device as claimed in claim 1, wherein said advancement drive means includes two advancement drives spaced from one another along said transverse direction, and wherein said toothed belt means includes two toothed belts associated with said advancement drives, respectively, each toothed belt having one strand thereof rigidly connected to said transfer means.

4. The advancement device as claimed in claim 3, wherein each rerouting roller means includes a pair of rerouting rollers, each rerouting roller defining an axis, the axes of each pair of rerouting rollers being aligned with one another so as to coincide with a corresponding axis of rotation.

5. The advancement device as claimed in claim 4, further including at least one shaft, a corresponding pair of rerouting rollers being mounted on said shaft.

6. The advancement device as claimed in claim 4, wherein each advancement drive has an outer side, and further including a motor disposed near one of said outer sides operatively driving one pair of said rerouting rollers.

7. The advancement device as claimed in claim 6, wherein said motor is disposed between the rerouting rollers of said one pair.

8. The advancement device as claimed in claim 1, wherein said connecting means rigidly connecting at least one of said strands to said transfer means includes locking means adjustable in tension.

9. The advancement device as claimed in claim 8, wherein said transfer means includes a threaded bore, and wherein said locking means includes at least one threaded bolt engaged with said threaded bore.

10. The advancement device as claimed in claim 1, wherein said connection means and said movement transfer means are constituted by only rigid member means.

11. In an advancement device for step-wise transport of material or of a workpiece, and particularly adapted for use in a press, and including two gripper rails spaced from one another and extending along a transport path, said gripper rails being reciprocally movable together along an advancement direction, which being movable in respective opposite directions along a direction transverse to the advancement direction, two longitudinal guides receiving said gripper rails, respectively, transverse drive means for driving said longitudinal guides in said respective opposite directions along said transverse direction, an advancement sled reciprocally movable along the advancement direction, advancement drive means for reciprocally driving said advancement sled along said advancement direction, said gripper rails being connected to said advancement sled rigidly along said advancement direction, but being movably connected thereto along said transverse direction, the improvement comprising at least one of said drive means including wrap-around drive means defining a drive direction, said wrap-around drive means including two rerouting roller means spaced from one another, each defining an axis of rotation extending approximately at right angles to said drive direction, and along said advancement direction, toothed belt means guided over said rerouting roller means, and having oppositely movable belt strands, said advancement sled being movable along said drive direction, connecting means rigidly connecting at least one of said belt strands to said advancement sled, said advancement sled being operatively connected to said gripper rails through at least one of said belt strands, a frame defining a longitudinal center line, a longitudinal border of a predetermined length, and a border of a predetermined width transverse to said longitudinal border, and coupling means linking said longitudinal gripper rails to said advancement sled, wherein said longitudinal guides are movably mounted on said frame, each longitudinal guide being movable along said transverse direction substantially in mirror symmetry away from, and towards said center line, and wherein transverse guide means are formed in said advancement sled for guiding said gripper rails therealong, and have a dimension extending at least along a major portion of said width.

12. The advancement device as claimed in claim 11, wherein each drive means is endless, and free from any rack- and pinion mechanism.

13. In advancement device as claimed in claim 11, wherein said transverse guide means is constituted by a groove for slidingly guiding said gripper rails therealong, and wherein said advancement drive means and said transverse drive means are disposed within the longitudinal and transverse borders of said frame.

* * * * *